US005125375A

United States Patent [19]

Vuk

[11] Patent Number: 5,125,375

[45] Date of Patent: Jun. 30, 1992

[54] CYLINDER LINER SEALING STRUCTURE

[75] Inventor: Carl T. Vuk, Shell Rock, Iowa

[73] Assignee: Deere & Company, Moline, Ill.

[21] Appl. No.: 765,789

[22] Filed: Sep. 26, 1991

[51] Int. Cl.[5] ..... F02F 11/00

[52] U.S. Cl. ..... 123/193.5; 123/193.3; 277/235 B; 277/168

[58] Field of Search ..... 123/193 CH, 193 C, 193 H, 123/193 R; 277/235 B, 235 R, 168

[56] References Cited

U.S. PATENT DOCUMENTS

| | | | |
|---|---|---|---|
| 4,791,897 | 12/1987 | Udagawa | 123/193 CH |
| 4,803,965 | 2/1989 | Udagawa | 123/193 CH |
| 4,809,653 | 3/1989 | Udagawa | 123/193 CH |

FOREIGN PATENT DOCUMENTS

| | | | |
|---|---|---|---|
| 2004602 | 4/1979 | United Kingdom | 277/235 B |
| 2083577 | 3/1982 | United Kingdom | 277/235 B |
| 2203806 | 10/1988 | United Kingdom | 277/235 B |

*Primary Examiner*—Andrew M. Dolinar
*Assistant Examiner*—M. Macy

[57] ABSTRACT

An internal combustion engine has a cylinder head, a cylinder block and a cylinder liner mounted in a bore in the block. The liner has a hollow cylindrical body and an annular sealing collar projecting radially outwardly from the body. The collar a sealing surface which faces generally towards the cylinder head. A cylinder head gasket the collar sealing surface and a corresponding head sealing surface on the cylinder head to preventing combustion gasses from escaping from the piston bore. The collar sealing surface is frustoconical and extends uniformly from a radially inner edge to a radially outer edge, the radially inner edge being farther from the outer sealing surface and the radially outer edge being closer to the other sealing surface. The frustoconical sealing surface resists radial expansion of the gasket and produces a wedging action which increases the sealing engagement of the gasket with the head and collar sealing surfaces as the gasket expands radially.

4 Claims, 1 Drawing Sheet

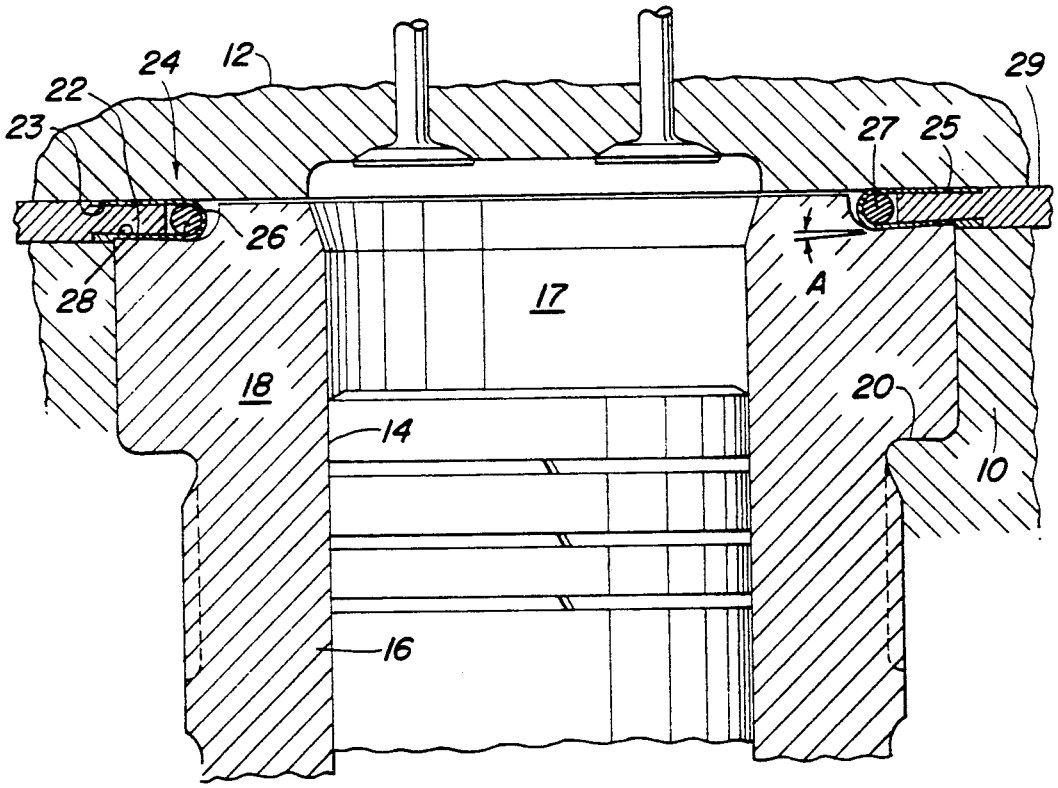
12
24
22
23
29
27
25
26
28
A
17
18
20
14
10
16

CYLINDER LINER SEALING STRUCTURE

BACKGROUND OF INVENTION

The present invention relates to a cylinder head sealing structure, and more particularly to a cylinder liner collar sealing structure for piston engines.

In known engine designs, such as shown in U.S. Pat. No. 3,481,316 or U.S. Pat. No. 3,363,608, a cylinder liner has an annular flange or collar at its upper end. This collar has a sealing surface which faces towards the cylinder head. An annular head gasket or fire ring is mounted between the collar and the cylinder head. Combustion pressures will tend to radially expand the head gasket during operation of the engine. The cylinder head to liner joint is one of the most critical areas of a Diesel engine. High temperature gasses at pressures frequently exceeding 2000 psi must be sealed under cyclic conditions. The head gasket must be compliant enough to seal surface imperfections, yet be stiff enough not to relax to the point where insufficient clamping load causes gasket blowout. To avoid such blowout, it is known in the prior art to clamp the liner collar between the cylinder head and a cylinder jacket. A disadvantage of such an arrangement is that the clamping forces will bend the collar so that its outer edge will be farther from the cylinder head than its inner edge. Such a condition increases the chances of sealing failure. Another disadvantage of such an arrangement is that considerable alternating forces caused by the forces occurring within the cylinder are transmitted to the collar to which have to be added the clamping forces. The result is the occurrence at the cylinder liner collar of considerable bending moments which one seeks to maintain small as possible by a corresponding dimensioning and arrangement of the clamping surfaces at the collar and at the abutment shoulders of the cylinder jacket.

SUMMARY OF THE INVENTION

An object of the present invention is to provide a cylinder liner collar sealing structure which resists head gasket blowout.

Another object of the present invention is to provide a such cylinder liner collar sealing structure which resists head gasket blowout without requiring large clamping forces.

Accordingly, it is an object of the present invention to provide a cylinder head seal for piston engines, especially for internal combustion engines, which effectively eliminates the shortcomings and drawbacks encountered in the prior art constructions.

This and other objects are achieved by the present invention wherein an engine has a cylinder head, a cylinder block and a cylinder liner mounted in a bore in the block. The liner has a hollow cylindrical body and an annular sealing flange or collar projecting radially outwardly from the body. The collar has a head sealing surface which faces generally towards the head. A head gasket or fire ring is mounted between the collar and the head for preventing combustion gasses from escaping from the piston bore. In cross section, the head sealing surface is slanted uniformly from a radially inner edge which is adjacent to the body to a radially outer edge, the radially inner edge being farther from the cylinder head and the radially outer edge being closer to the cylinder head. The head sealing surface therefore forms an annular frustoconical surface which is concave towards the cylinder head. As a result, the head sealing surface resists radial expansion of the head gasket and produces a wedging action which increases the sealing engagement of the head gasket with the cylinder head and the head sealing surface as the head gasket expands radially.

BRIEF DESCRIPTION OF THE DRAWINGS

The sole FIGURE is cross-sectional view of a portion of a Diesel engine showing the present invention.

DETAILED DESCRIPTION

Referring now to the drawing, the FIGURE shows a cross sectional view through the upper portion of an internal combustion engine cylinder provided with the cylinder head seal arrangement in accordance with the present invention.

The engine includes a cylinder block 10, a cylinder head 12 and a hollow cylinder liner 14 surrounding a piston bore 17. The liner 14 has a cylindrical body 16 and an annular collar or flange 18. The collar 18 rests on a countershoulder 20 of the cylinder jacket housing or block 10. The collar 18 has an annular collar sealing surface 22 which faces generally towards a head sealing surface 23 on the cylinder head 12. A head gasket 24, such as available from the Victor Products Division of Dana Corporation, is mounted between the 10 collar 18 and the head 12 for preventing combustion gasses from escaping from the piston bore. The head gasket 24 includes a sleeve 25, a fire ring 27, and an annular ring of gasket material 29. The arrangement so far described is known in the prior art.

According to the present invention, viewing the portion of the collar sealing surface 22 shown in the FIGURE in cross-section, the collar sealing surface 22 has a profile which is slanted or tilted uniformly with respect to the plane containing sealing surface 23 from a radially inner edge 26 to a radially outer edge 28. The inner edge 26 is farther from the cylinder head 12 and the outer edge 28 is closer to the cylinder head 12. The angle A of the slant or tilt is preferably approximately 2 degrees. The amount of slant or tilt is exaggerated in the drawing for purposes of clarity. Thus, the entire collar sealing surface 22 forms an annular frustoconical surface which is concave towards the cylinder head 12. This frustoconical collar sealing surface 22 resists radial expansion of the head gasket 24 and produces a wedging action which increases the sealing engagement of the head gasket 24 with the cylinder head 12 and the collar sealing surface 22 as the head gasket 24 expands radially. Preferably, the outer edge 28 extends approximately 0.0004 inches beyond the adjacent edge of the cylinder block 10. The step formed therebetween helps to grip and hold in place the sleeve 25 of the head gasket 24.

While the invention has been described in conjunction with a specific embodiment, it is to be understood that many alternatives, modifications and variations will be apparent to those skilled in the art in light of the foregoing description. For example, instead of the concave frustoconical collar sealing surface, a mirror image concave frustoconical sealing surface could be formed in the portion of the cylinder head next to the collar. Accordingly, this invention is intended to embrace all such alternatives, modifications and variations which fall within the spirit and scope of the appended claims.

I claim:

1. In an engine having a cylinder head, a cylinder block and a cylinder liner, the liner being mounted in a bore in the block, the liner and the head cooperating to define a piston bore, the liner having a hollow cylindrical body and an annular sealing collar projecting radially outwardly from the body, the collar engaging the block and having a collar sealing surface which faces generally towards the cylinder head, and sealing means engaging the collar sealing surface and a corresponding head sealing surface on the cylinder head for preventing combustion gasses from escaping from the piston bore, characterized by:

one of the sealing surfaces is frustoconical and extends uniformly from a radially inner edge to a radially outer edge, the radially inner edge being farther from the other sealing surface and the radially outer edge being closer to the other sealing surface, the frustoconical sealing surface resisting radial expansion of the sealing means and producing a wedging action which increases the sealing engagement of the sealing means with the head and collar sealing surfaces as the sealing means expands radially.

2. The invention of claim 1, wherein:

in cross-section, the frustoconical sealing surface is tilted with respect to the other sealing surface by an angle of approximately 2 degrees.

3. In an engine having a cylinder head, a cylinder block and a cylinder liner, the liner being mounted in a bore in the block, the liner and the head cooperating to define a piston bore, the liner having a hollow cylindrical body and an annular sealing collar projecting radially outwardly from the body, the collar engaging the block and having a collar sealing surface which faces generally towards the cylinder head, and sealing means engaging the collar sealing surface and engaging a corresponding head sealing surface on the cylinder head for preventing combustion gasses from escaping from the piston bore, characterized by:

the collar sealing surface is frustoconical and extends uniformly from a radially inner edge which is adjacent to the body to a radially outer edge, the radially inner edge being farther from the cylinder head and the radially outer edge being closer to the cylinder head, the frustoconical collar sealing surface resisting radial expansion of the sealing means and producing a wedging action which increases the sealing engagement of the sealing means with the head and collar sealing surface as the sealing means expands radially.

4. The invention of claim 1, wherein:

in cross-section, the collar sealing surface is tilted with respect to the head sealing surface by an angle of approximately 2 degrees.

* * * * *

UNITED STATES PATENT AND TRADEMARK OFFICE

CERTIFICATE OF CORRECTION

PATENT NO. : 5,125,375

DATED : June 30, 1992

INVENTOR(S) : Carl T. Vuk

It is certified that error appears in the above-indentified patent and that said Letters Patent is hereby corrected as shown below:

Column 4, line 24, delete "1" and insert -- 3 --.

Signed and Sealed this

Twenty-first Day of December, 1993

*Attest:*

*Attesting Officer*

Bruce Lehman

BRUCE LEHMAN

*Commissioner of Patents and Trademarks*